US006068143A

United States Patent [19]

Wang

[11] Patent Number: 6,068,143

[45] Date of Patent: May 30, 2000

[54] DEVICES FOR FASTENING SHELVES TO UPRIGHT SUPPORT RODS

[76] Inventor: Chang Chou Wang, 62, Lane 627, Sec. 7, Er Chi Rd., Er Lin Township, Changhua, Taiwan

[21] Appl. No.: 09/198,462

[22] Filed: Nov. 24, 1998

[51] Int. Cl.[7] ..... A47B 57/34

[52] U.S. Cl. ..... 211/187; 108/144.11

[58] Field of Search ..... 211/187, 181.1, 211/208; 108/147.13, 106, 107, 144.11, 192; 248/423

[56] References Cited

U.S. PATENT DOCUMENTS

| | | | |
|---|---|---|---|
| 3,757,705 | 9/1973 | Maslow | 108/147.13 |
| 4,128,064 | 12/1978 | Chung et al. | 108/144.11 |
| 4,318,352 | 3/1982 | Friedman et al. | 108/147.13 |
| 4,444,125 | 4/1984 | Welsch et al. | 108/147.13 |
| 4,527,490 | 7/1985 | Tipton et al. | 108/106 |
| 4,595,107 | 6/1986 | Welsh | 108/147.13 |
| 4,615,278 | 10/1986 | Cabrelli | 108/147.13 |
| 4,627,543 | 12/1986 | Nicely | 108/147.13 X |
| 4,656,952 | 4/1987 | Schweizer | 108/147.13 |
| 4,799,818 | 1/1989 | Sudimak et al. | 108/147.13 |
| 4,852,501 | 8/1989 | Olson et al. | 108/147.13 X |
| 5,127,342 | 7/1992 | Taylor | 108/147.13 |
| 5,884,567 | 3/1999 | Bartz, Jr. | 108/106 |
| 5,924,581 | 7/1999 | Chen | 108/192 |

*Primary Examiner*—Daniel P. Stodola
*Assistant Examiner*—Jennifer E. Novosad
*Attorney, Agent, or Firm*—Bacon & Thomas PLLC

[57] ABSTRACT

A rack is formed of a plurality of support rods for supporting a plurality of shelves in conjunction with a plurality of locating sleeves and fastening sleeves. The locating sleeves are located on the support rods, whereas the fastening sleeves are fixedly fastened with the shelves by the locating sleeves. The locating sleeves are formed of a first arcuate body provided with an insertion slot, a tenon and a retaining protrusion, and a second arcuate body provided with an insertion slot, a mortise and a retaining protrusion. The locating sleeves are located on the support rods such that the retaining protrusions of the first arcuate body and the second arcuate body are retained in the retaining slots of the support rods, and that the tenon of the first arcuate body is retained in the mortise of the second arcuate body. The fastening sleeves are provided with a gap and two retaining potions separated from each other by the gap. The fastening sleeves are located such that the retaining portions of the fastening sleeves are retained in the insertion slots of the first arcuate body and the second arcuate body of the locating sleeves.

3 Claims, 10 Drawing Sheets

DEVICES FOR FASTENING SHELVES TO UPRIGHT SUPPORT RODS

FIELD OF THE INVENTION

The present invention relates generally to a rack for holding and displaying various articles, and more particularly to devices for fastening a shelf to an upright support rod of the rack.

BACKGROUND OF THE INVENTION

As shown in FIGS. 7 and 8, a prior art rack is formed of a plurality of upright support rods 3 and shelves 8 which are fastened with the support rods 3 by a plurality of fastening sleeves 81 in conjunction with a plurality of locating sleeves 7. The fastening sleeves 81 are of a tapered construction and are fastened fixedly at corners of the shelves 8. The locating sleeves 7 are of a tapered construction and composed of two pieces which are provided in the inner wall thereof with a retaining protrusion 71. The upright support rods 3 are provided in the outer surface thereof with a plurality of retaining slots 31, which are arranged at an interval. In combination, the locating sleeves 7 are first fastened at the desired levels of the upright support rods 3 such that the retaining protrusions 71 of the locating sleeves 7 are securely retained in the retaining slots 31 of the support rods 3. The shelves 8 are then located at the desired levels of the support rods 3 by fitting the fastening sleeves 81 over the locating sleeves 7 such that the fastening sleeves 81 of the shelves 8 are located by the locating sleeves 7.

The prior art rack described above is defective in design in that it is rather time-consuming to add or reduce shelves 8 of the rack because of the fact that the existing shelves 8 must be first dismantled. In addition, when two or more racks of the prior art are joined together, the shelves 8 of one rack can not be flush with the shelves 8 of other rack, as shown in FIG. 8.

SUMMARY OF THE INVENTION

The primary objective of the present invention is therefore to provide two improved devices for fastening shelves with support rods of a rack, without the shortcomings of the prior art rack described above.

The devices of the present invention are of a tapered construction and formed of two arcuate bodies which are fused together at one side thereof. One of the arcuate bodies is provided in the free side thereof with a retaining protrusion, whereas other one of the arcuate bodies is provided in the free side thereof with a retaining slot. Both free sides of the two arcuate bodies are joined together to form the device of the present invention such that the retaining protrusion is retained in the retaining slot. The arcuate bodies are further provided in the inner wall thereof with a retaining strip, which is retained in one of the retaining recesses of the support rods of a rack when the device of the present invention is located at a desired level of the support rod of the rack. The device serves to locate the fastening sleeves which are fastened fixedly with the comers of a shelf of the rack.

The objective, features, functions and advantages of the present invention will be more readily understood upon a thoughtful deliberation of the following detailed description of the present invention with reference to the accompanying drawings.

DETAILED DESCRIPTION OF THE INVENTION

Figure 1:
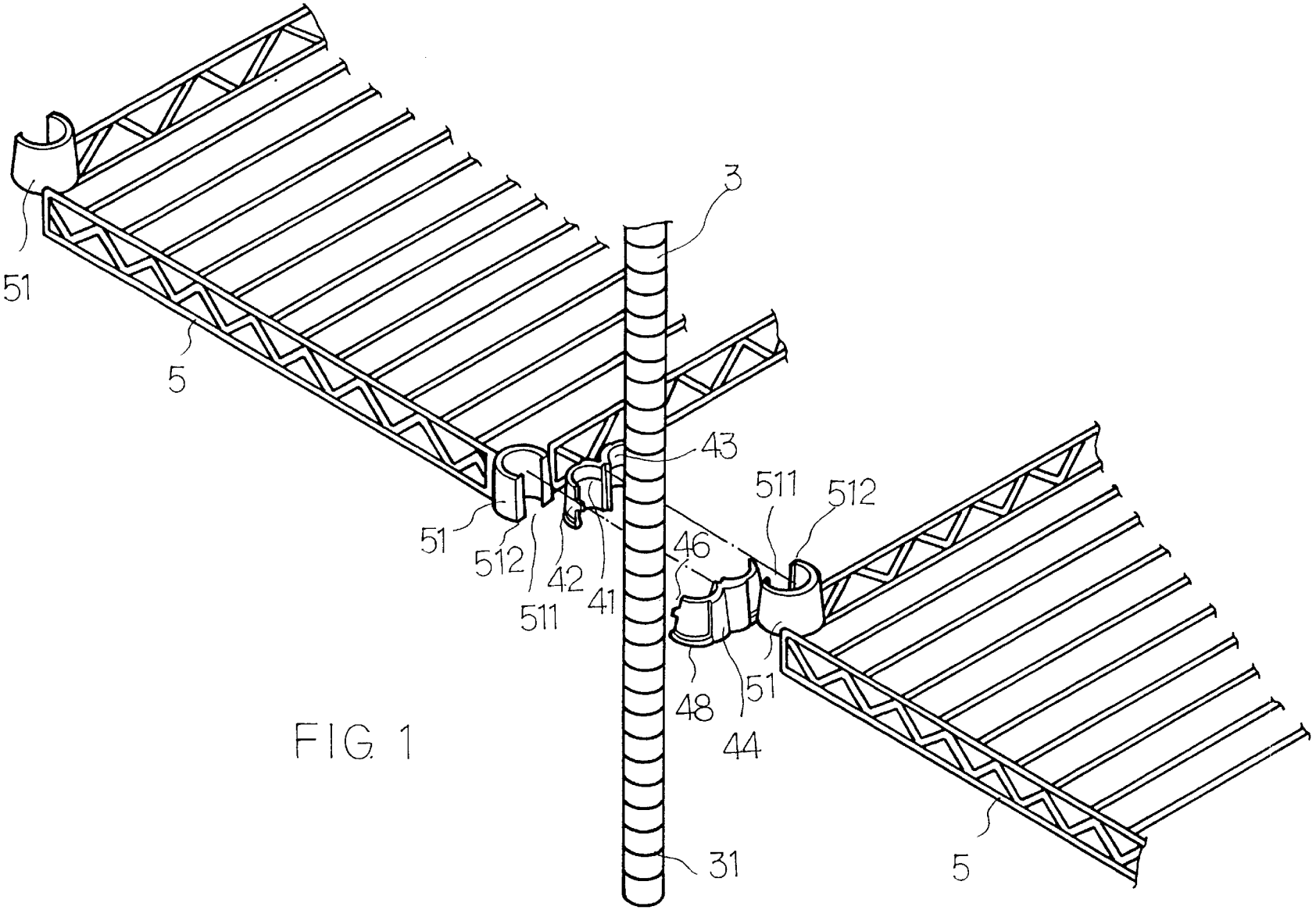
FIG. 1 shows an exploded view of the present invention.
Figure 2:
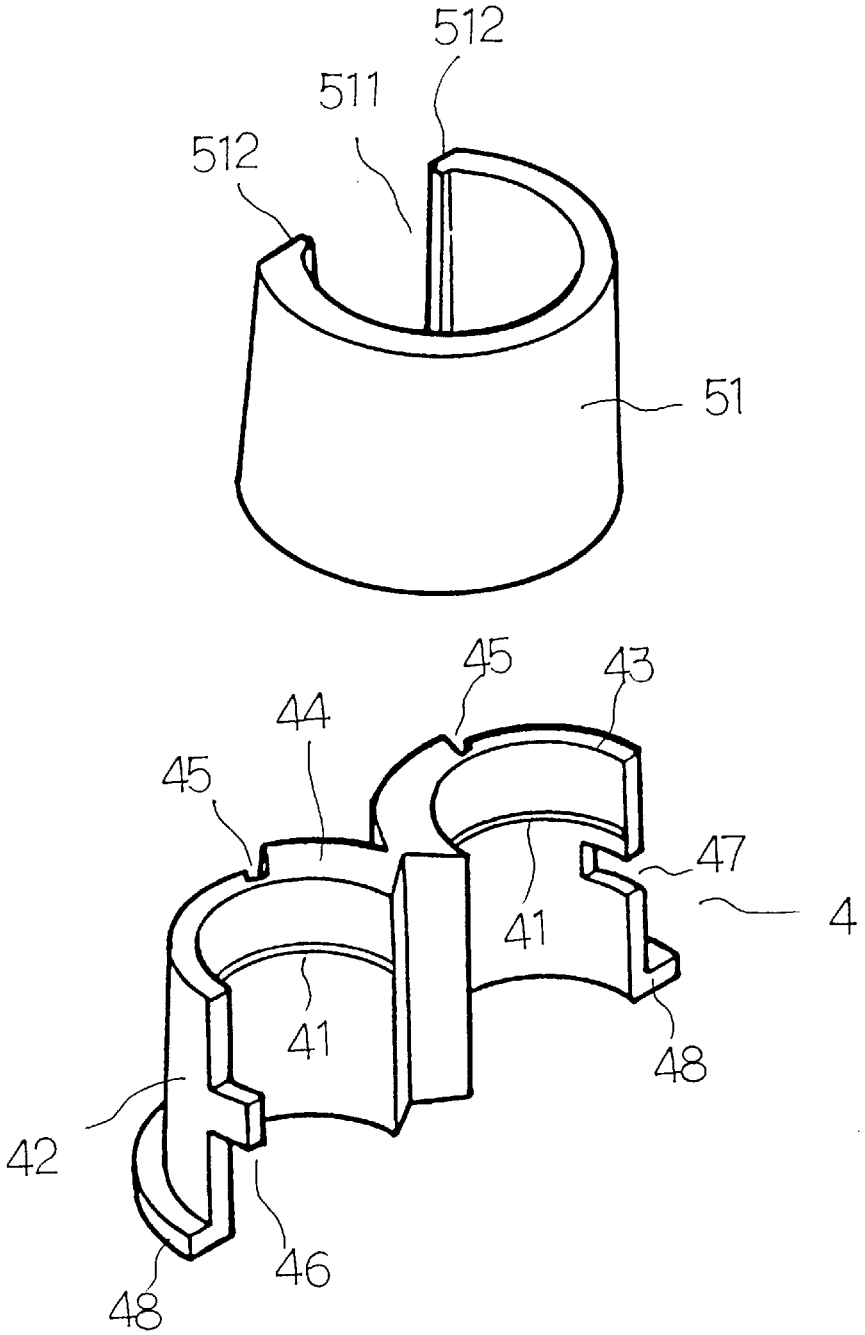
FIG. 2 shows a schematic view of the structure of the present invention.

As shown in FIGS. 1 and 2, a rack of the present invention is composed of a plurality of support rods 3, shelves 5, fastening sleeves 51, and locating sleeves 4. Each of the support rods 3 is provided in the outer surface thereof with a plurality of retaining slots 31 which are arranged at an interval. The locating sleeves 4 are provided in the inner wall thereof with a retaining protrusion 41. The locating sleeves 4 are located at a desired level of the support rod 3 such that the retaining protrusion 41 is retained in the retaining slot 31 of the support rod 3. The shelves 5 are supported by the support rods 3 such that the fastening sleeves 51 are located by the locating sleeves 4.

The present invention is characterized in that the locating sleeves 4 are formed of two arcuate bodies 42 and 43, which are provided with a pliable protruded portion 44 having an insertion slot 45. The first arcuate body 42 is provided in the connection side thereof with a tenon 46, whereas the second arcuate body 43 is provided in the connection side thereof with a mortise 47. The two arcuate bodies 42 and 43 are provided in the bottom edge thereof with a stop portion 48, and in the inner wall thereof with a retaining protrusion 41. The shelves 5 are provided with a plurality of fastening sleeves 51 which are fastened fixedly with four corners of the shelves 5. The fastening sleeves 51 are provided with a gap 511 such that each of the fastening sleeves 51 is provided with two retaining portions 512 separated from each other by the gap 511.

Figure 3:
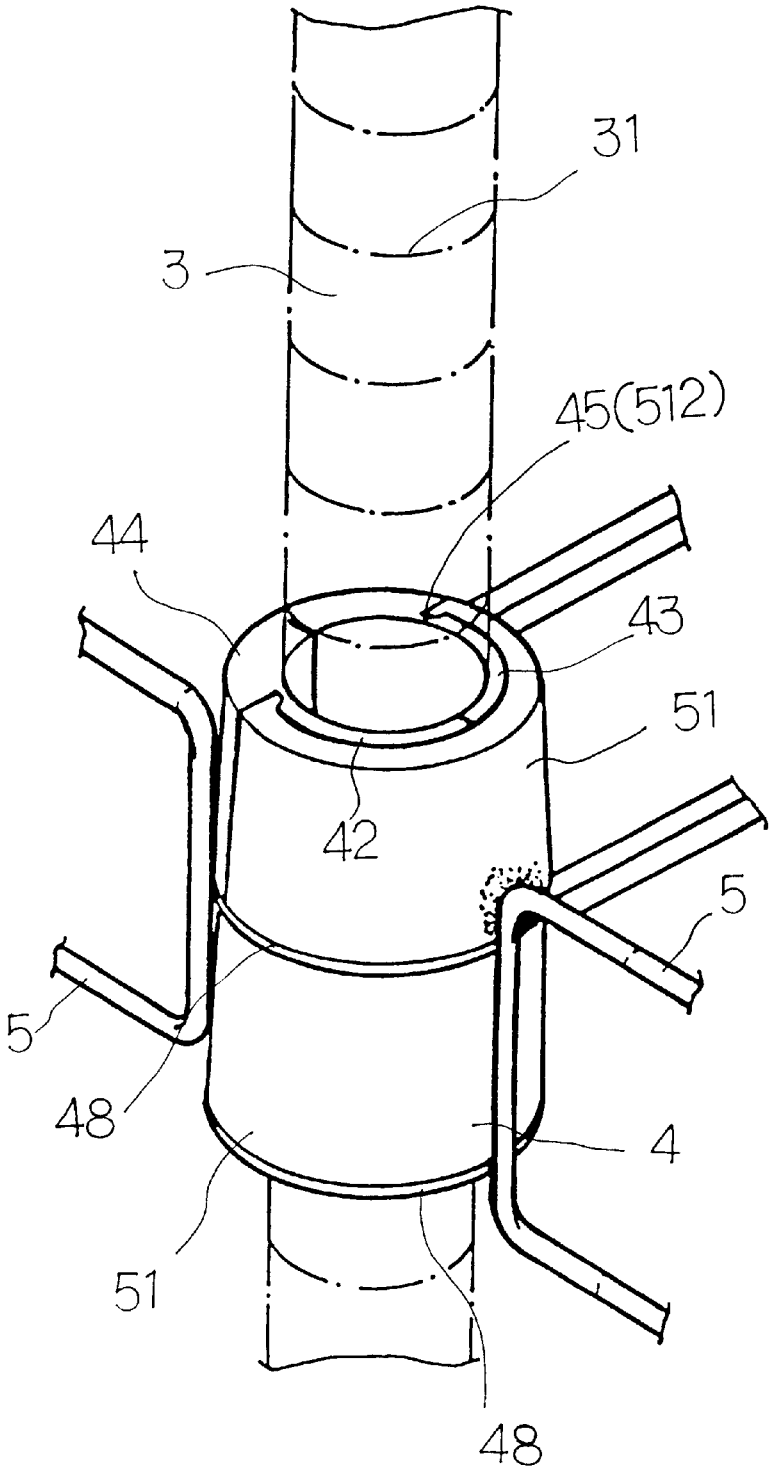
FIG. 3 shows a schematic view of the present invention in conjunction with an upright support rod of a rack.
Figure 3A:
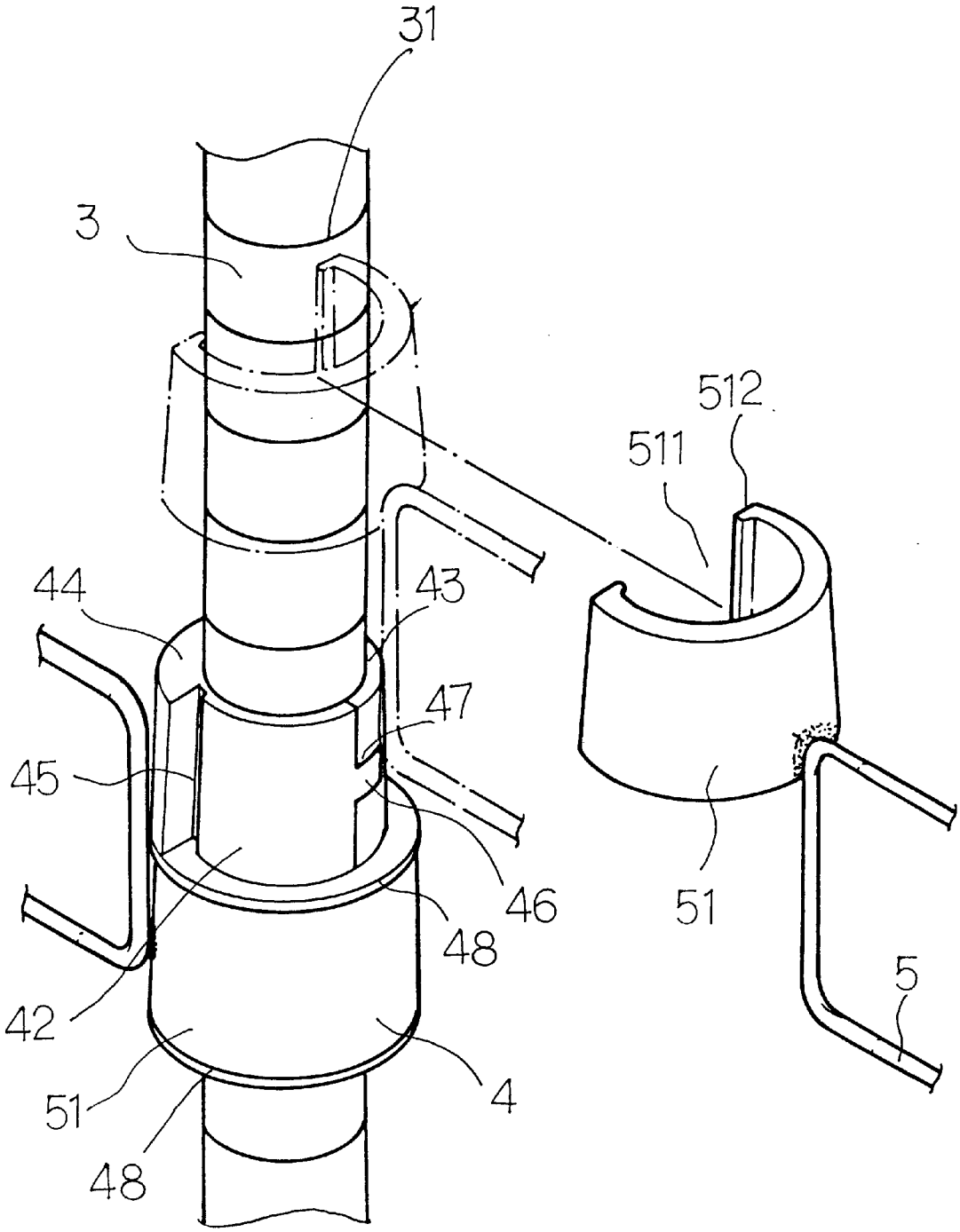
FIG. 3A shows a schematic view of two racks that are joined together side by side in conjunction with the devices of the present invention.
Figure 4:
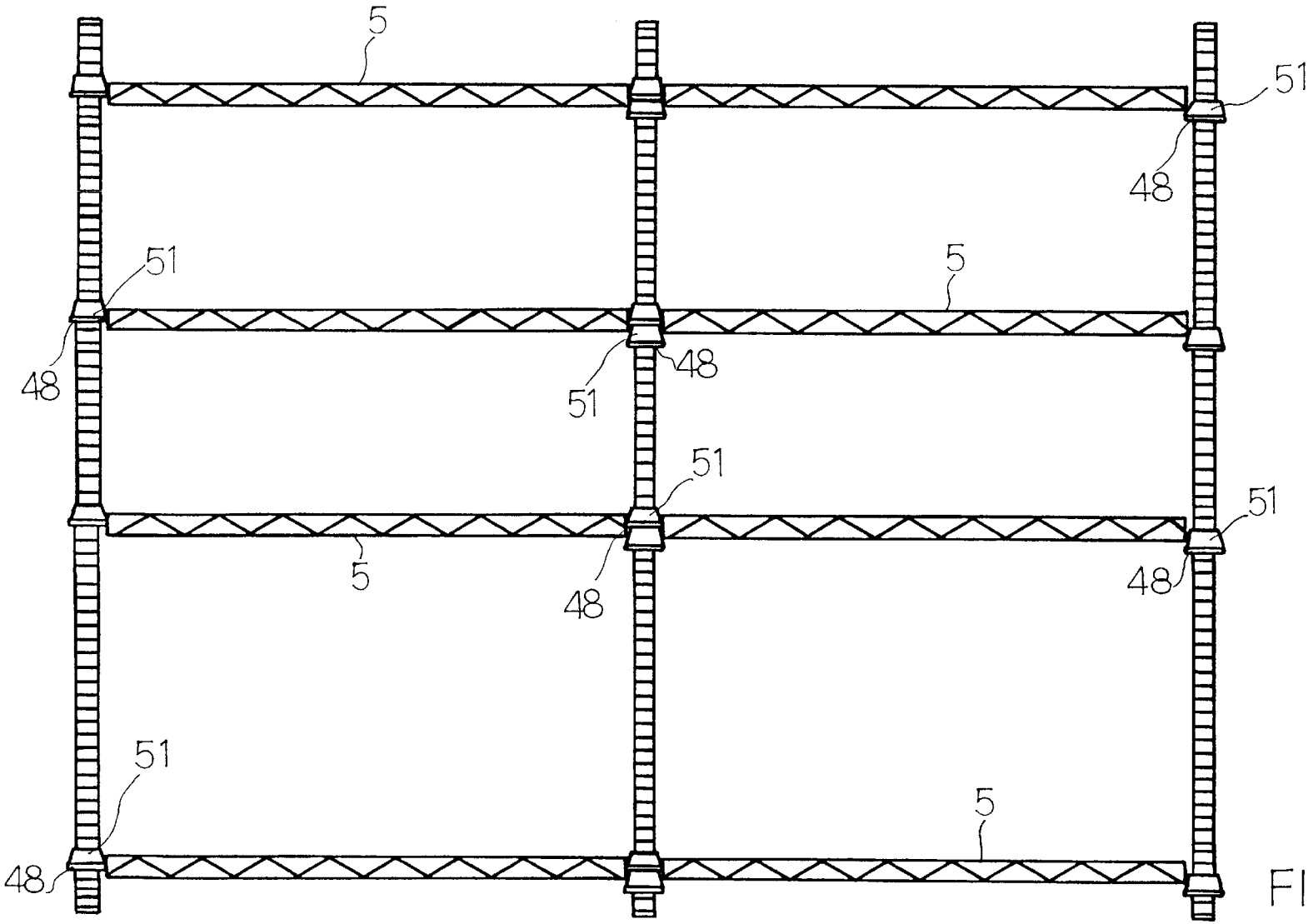
FIG. 4 shows a schematic view of the present invention at work.

As shown in FIGS. 3, 3A and 4, the locating sleeve 4 can be located at a desired level of the support rod 3 such that the retaining protrusions 41 of the arcuate bodies 42 and 43 of the locating sleeve 4 are retained securely in the retaining slot 31 of the support rod 3. The shelf 5 is supported by the support rod 3 by means of the fastening sleeves 51 which are located by the locating sleeves 4. In the meantime, the retaining portions 512 of the fastening sleeve 51 are retained in the insertion slots 45 of the arcuate bodies 42 and 43 of the locating sleeve 4.

Figure 5:
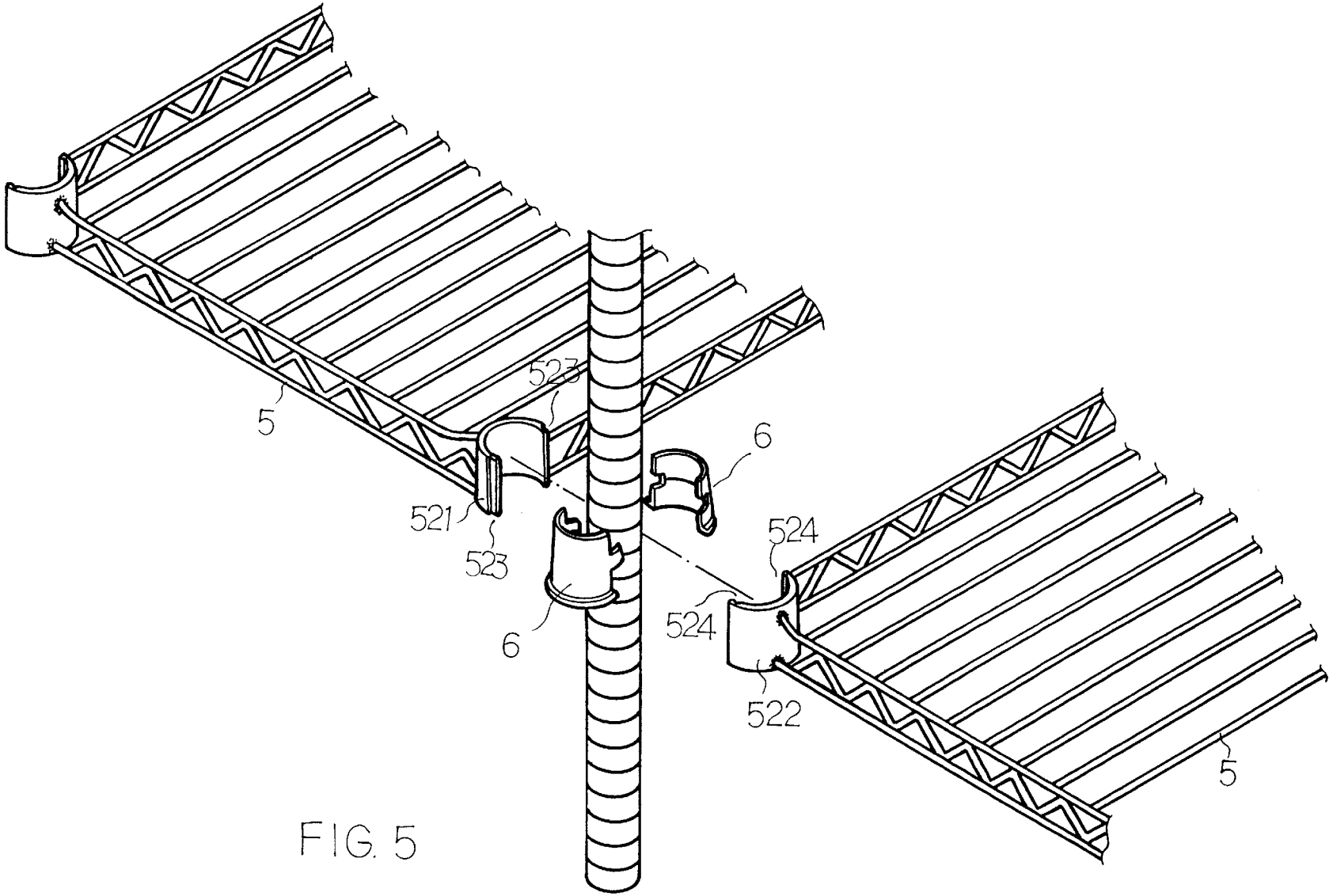
FIG. 5 shows an exploded view of another preferred embodiment of the present invention.
Figure 6:
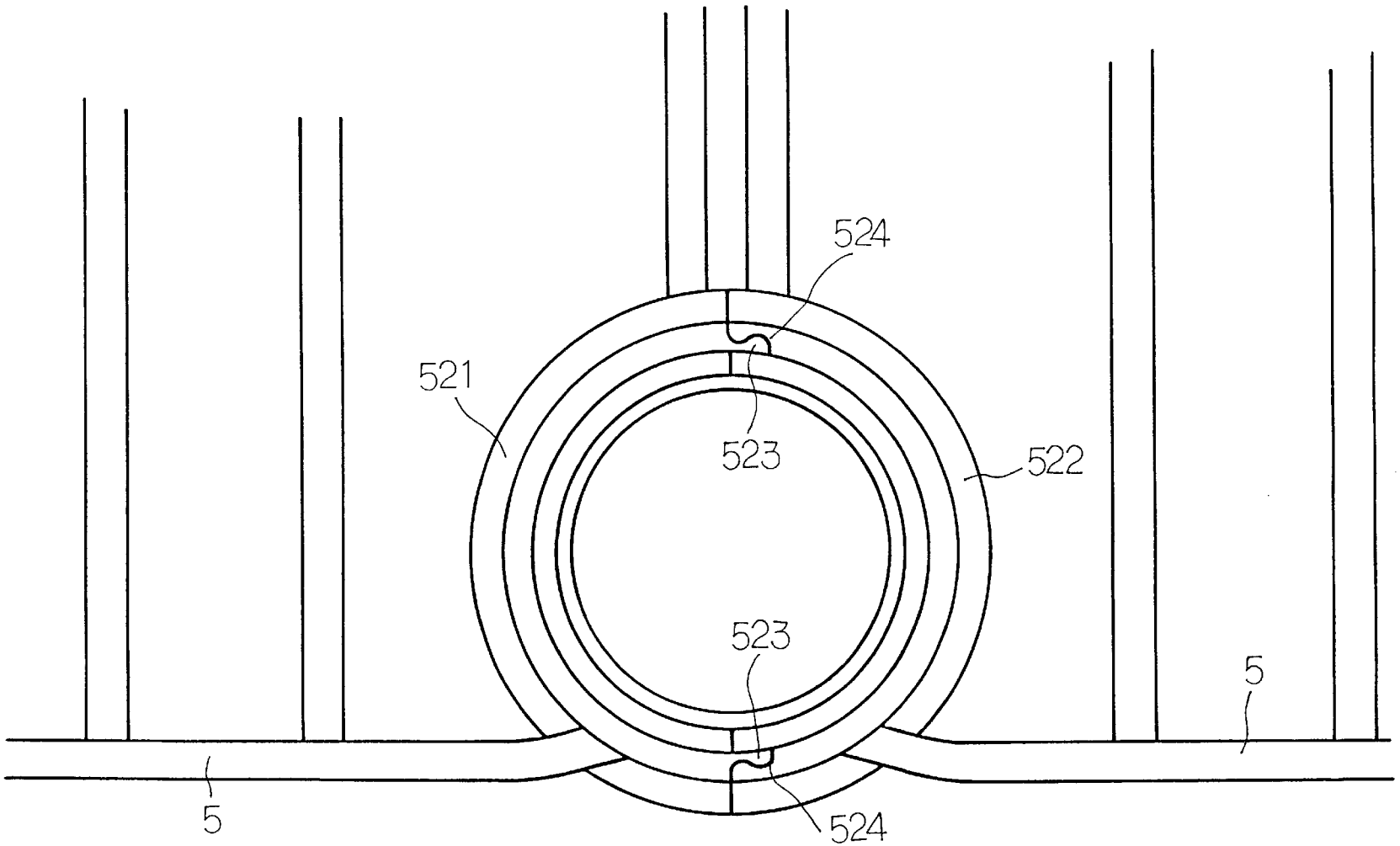
FIG. 6 shows a schematic view of another preferred embodiment of the present invention in combination.
Figure 6A:
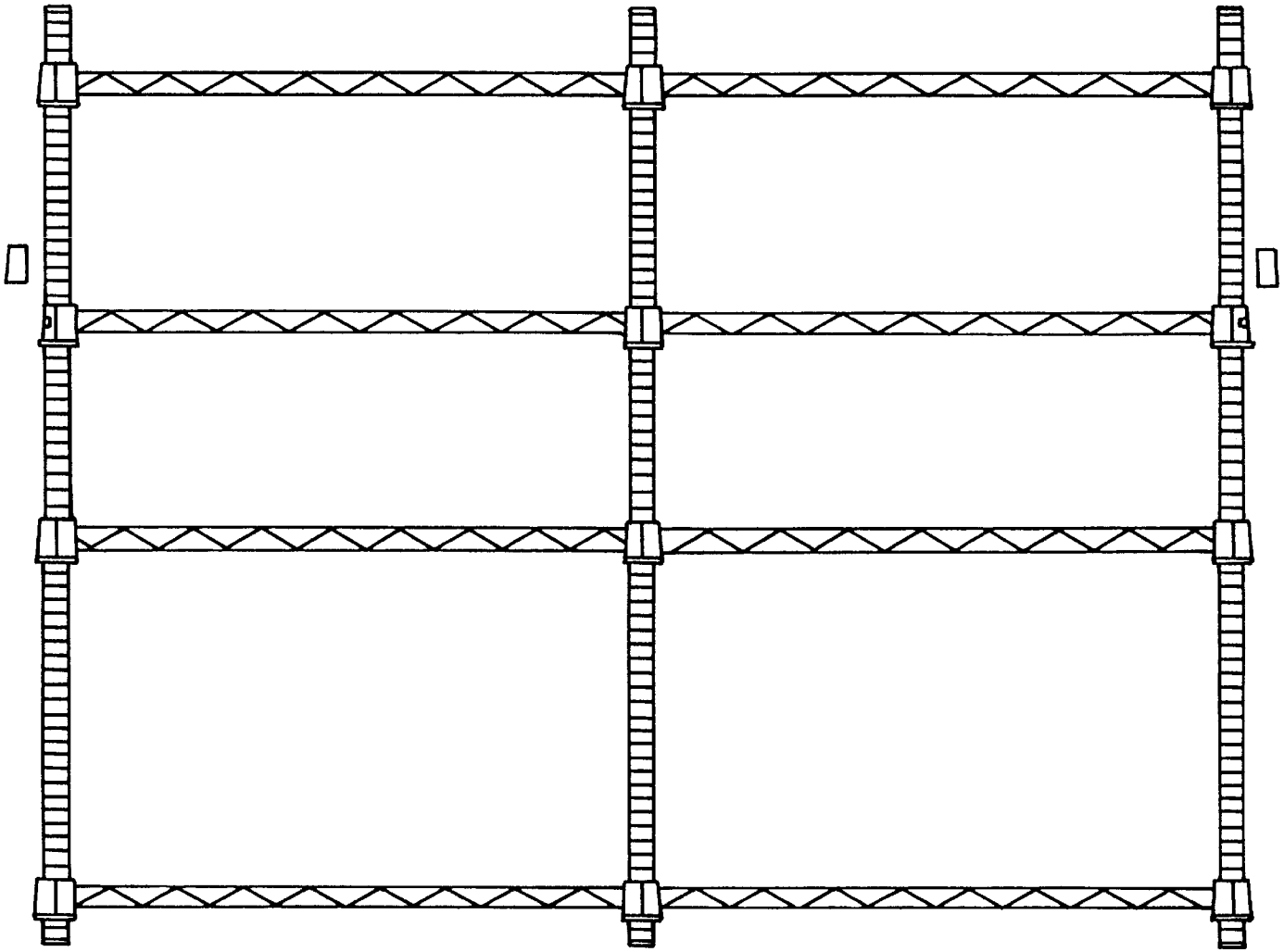
FIG. 6A shows a schematic view of a rack formed by another structure of the present invention.
Figure 7:
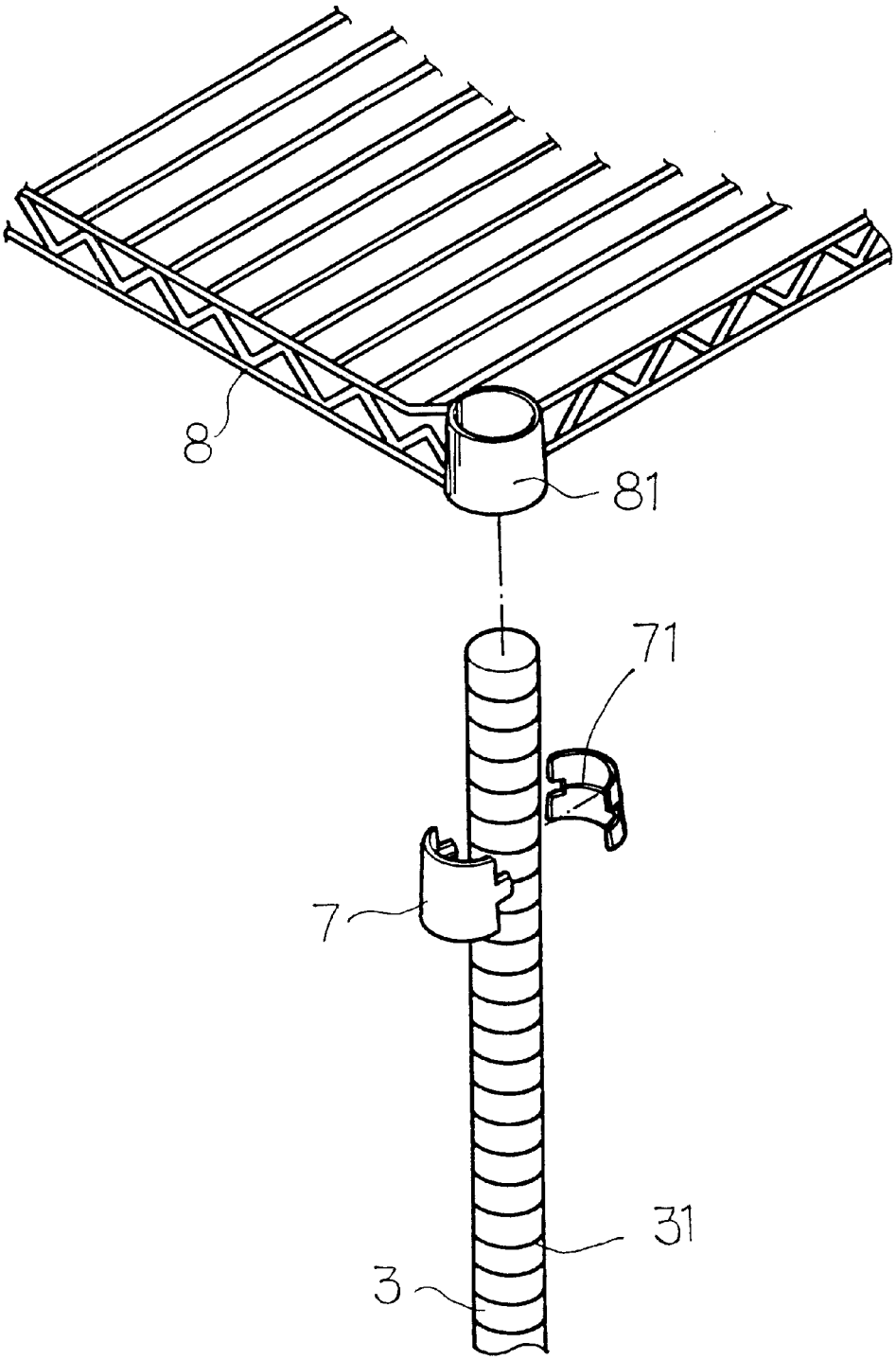
FIG. 7 PRIOR ART
FIG. 7 shows an exploded view of a prior art structure.
Figure 8:
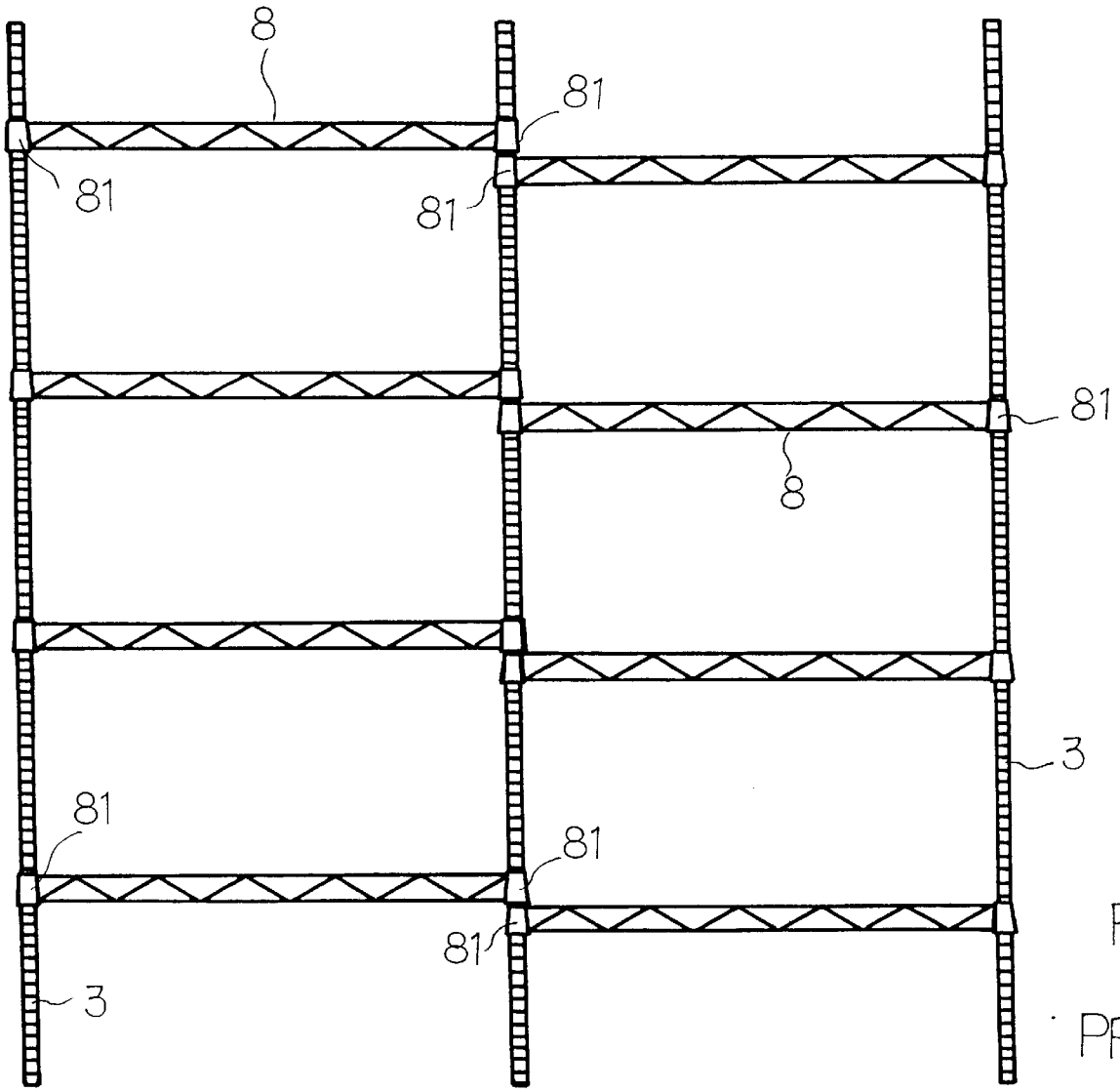
FIG. 8 PRIOR ART
FIG. 8 shows a schematic view of a rack formed of two prior art racks.

As shown in FIGS. 5, 6, and 6A, a fastening sleeve 52 of another type is formed of two symmetrical bodies 521 and 522, which are fastened fixedly and separately with two shelves 5. The first body 521 is provided with two retaining portions 523, whereas the second body 522 is provided with two retaining slots 524. As these two bodies 521 and 522 are joined together in conjunction with a locating sleeve 6 which is located at a level of the support rod, the retaining portions 523 of the first body 521 are retained by the retaining slots 524 of the second body 522.

The embodiments of the present invention described above are to be deemed in all respects as being merely illustrative and not restrictive. Accordingly, the present invention may be embodied in other specific forms without deviating form the spirit thereof. The present invention is therefore to be limited only by the scopes of the following appended claims.

What is claimed is:

1. A rack, comprising a plurality of upright support rods each having an outer surface with a plurality of retaining slots arranged thereon, a plurality of locating sleeves, a plurality of shelves, and a plurality of fastening sleeves fixedly fastened to corners of the shelves, the shelves being supported by the support rods in conjunction with the fastening sleeves and the locating sleeves; wherein said locating sleeves are formed of a first arcuate body and a second arcuate body, said first arcuate body provided with a tenon projecting from an end thereof, and a retaining protrusion located on an inner wall thereof, said second arcuate body provided with a mortise formed in an edge thereof, and a retaining protrusion located on an inner wall thereof, said locating sleeves being located on the support rods such that said retaining protrusions of said first arcuate body and said second arcuate body are retained in one of the retaining slots of the support rod, and that said tenon of said first arcuate body is retained in said mortise of said second arcuate body; and wherein said fastening sleeves are formed of a first body and a second body which is symmetrical in construction to said first body, said first body and said second body being fixedly fastened to separate shelves, said first body provided with two retaining portions, said second body provided with two retaining slots, said first body and said second body being joined together such that said retaining portions of said first body are retained by said retaining slots of said second body.

2. The rack recited in claim 1 wherein at least one of the retaining portions includes a tongue having a raised portion for engaging one of the retaining slots.

3. The rack recited in claim 1, wherein the locating sleeves include stop portions at a bottom end thereof for abutting a bottom portion of the fastening sleeves.

* * * * *